United States Patent [19]

Rea et al.

[11] Patent Number: 4,761,926

[45] Date of Patent: Aug. 9, 1988

[54] TILE MOUNTING SYSTEM

[76] Inventors: Philip L. Rea, "Melleray", 7A, Hillcrest Road, Ealing, London W5 2JL; Stanley R. Bagshaw, 19 Georgewood Road, Hemel, Hempstead, Hertfordshire HP3 8AL, both of England

[21] Appl. No.: 873,346

[22] Filed: Jun. 12, 1986

[30] Foreign Application Priority Data

Jun. 21, 1985 [GB] United Kingdom ..... 8515769

[51] Int. Cl.[4] ..... E04F 13/08

[52] U.S. Cl. ..... 52/387; 52/388; 52/389

[58] Field of Search ..... 52/386, 387, 388, 389, 52/180, 181, 385

[56] References Cited

U.S. PATENT DOCUMENTS

| | | | |
|---|---|---|---|
| 421,742 | 2/1890 | Marsh | 52/387 |
| 903,183 | 11/1908 | Eggles | 52/387 |
| 1,836,964 | 12/1931 | Grigsby et al. | 52/387 |
| 1,850,961 | 3/1932 | Mortenson | 52/387 |
| 1,932,274 | 10/1933 | Kublanow | 52/385 |
| 1,932,276 | 10/1933 | Kublanow | 52/385 |
| 2,114,710 | 4/1938 | Holcomb | 52/387 |
| 2,852,932 | 9/1958 | Cable | 52/385 |
| 4,026,083 | 5/1977 | Hoyt et al. | 52/387 |
| 4,087,948 | 5/1978 | Mellor | 52/180 |
| 4,226,064 | 10/1980 | Kraayenhof | 52/180 |

FOREIGN PATENT DOCUMENTS

| | | | |
|---|---|---|---|
| 2753501 | 7/1979 | Fed. Rep. of Germany | 52/386 |
| 712127 | 7/1966 | Italy | 52/387 |

*Primary Examiner*—Carl D. Friedman

*Attorney, Agent, or Firm*—Arnold S. Weintraub

[57] ABSTRACT

A synthetic plastics or other flexible but substantially inextensible tiling matrix 1 is provided defining an apertured portion 2 formed with openings 3, half-sized openings 5, and quarter-sized openings 4, one surface of the matrix portion 2 being provided with cruciform and rectilinear projections 9 between which tiles can be installed. The matrix 1 is secured to a wall or other surface that is to be tiled by use of an adhesive and the tiles are secured to that wall or other surface and to the matrix portion 2 by a conventional tiling adhesive following which grouting is installed between the regularly spaced apart tiles in a conventional manner. The projections 9 have a projecting extent that is less than the thickness of the tiles so that they will be concealed after grouting has been completed. Edges of each matrix portion 2 are provided with interlocking projections 6 and recesses 7 so that one matrix portion 2 can quickly and accurately be positioned in line relative to others. Projections 8 are provided to assist in alignment relative to the edges of walls, floors, ceilings and other surfaces and any guide lines that may be marked thereon. Areas of the matrix 1 that incorporate a lip to finish the free edge of a tiled area and areas thereof that are hingedly interconnected to flank angular corners between walls or other surfaces are both described and illustrated.

12 Claims, 4 Drawing Sheets

TILE MOUNTING SYSTEM

This invention relates to a system for the mounting of tiles on vertical, horizontal or oblique surfaces and can thus be employed in the tiling of walls, floors, ceilings and other surfaces which are inclined both to the vertical and the horizontal. It is conventional for tiles, and particularly glazed ceramic tiles, to be fixed to flat surfaces by an adhesive which is appropriate to the nature of the tiles themselves and the surface upon which they are to be mounted, the tiles being uniformly spaced apart from one another by relatively short distances and the spacing between them being filled by so-called "grouting" to produce the neat and pleasing finish which is well known to everyone. Experienced professional tilers can apply tiles to a large area at a rapid rate and will produce the finish that has just been mentioned with very few, if any, blemishes or noticeable irregularities. However, when the amateur tiler attempts a similar job, he/she discovers that the work of the professional tiler is much more difficult than it appears and cannot be easily duplicated without a lot of experience and the acquisition of "know-how" for which the mere reading of instructive literature is no substitute even though it may be of some help.

According to the invention, there is provided a tiling system characterised in that it comprises the provision of a matrix defining an apertured portion for adhesive attachment to a surface that is to be tiled, the apertured portion being either permanently provided with, or being constructed to receive, a pattern of projections whose sizes and positions are such that, in use, tiles can fit between the projections and be adhesively secured to said surface by way of the apertured portion and the openings therein whilst being regularly spaced apart from one another by said projections to facilitate uniform grouting between the tiles.

Figure 1:
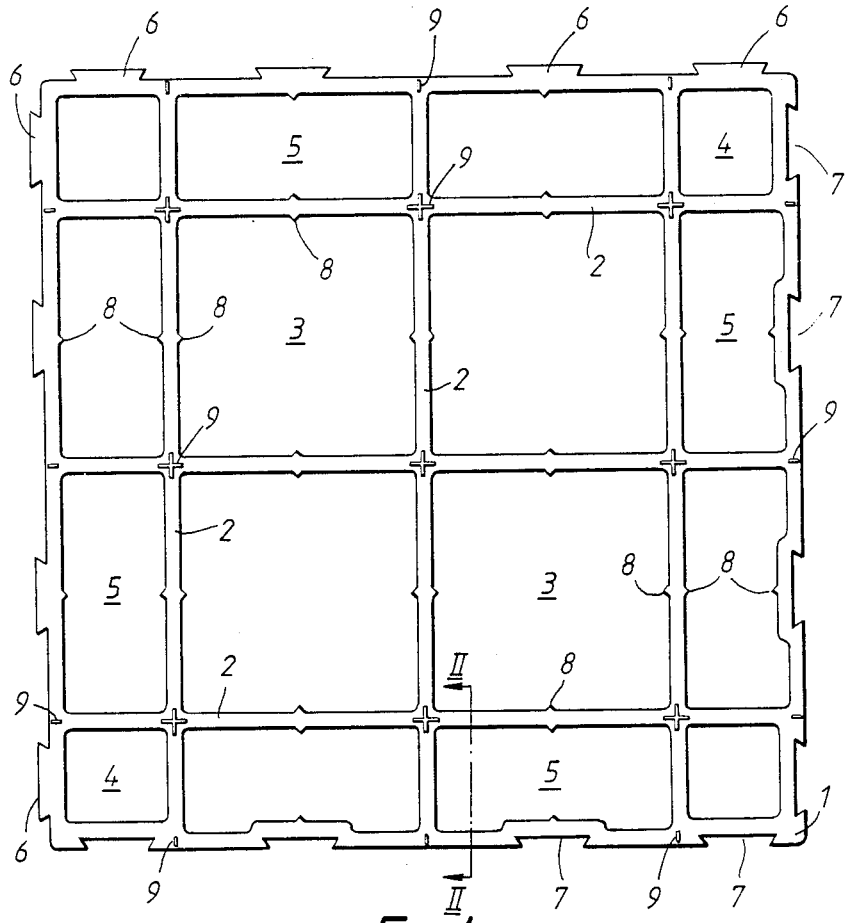
Figure 2:
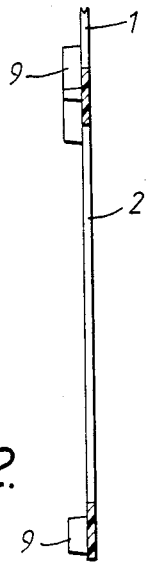
Figure 3:
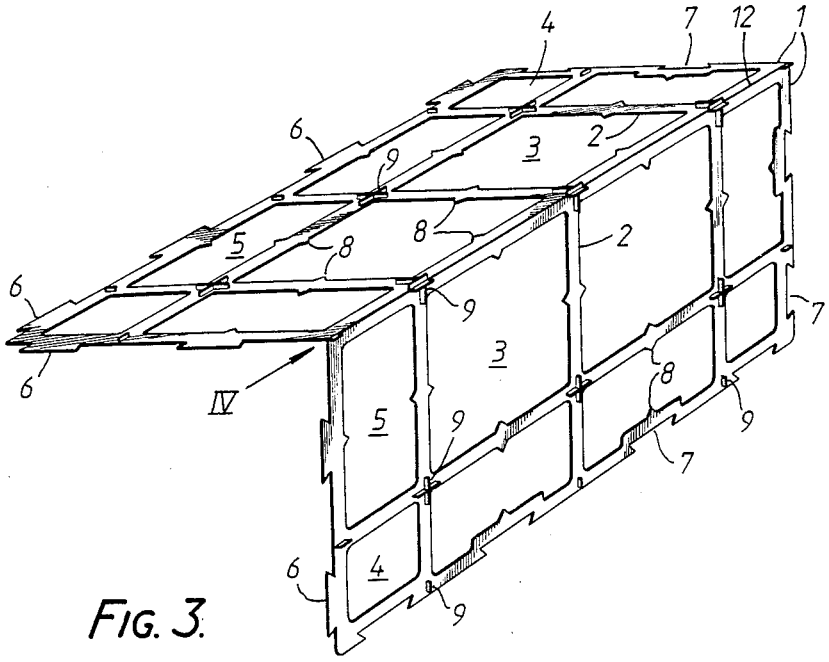
Figure 4:
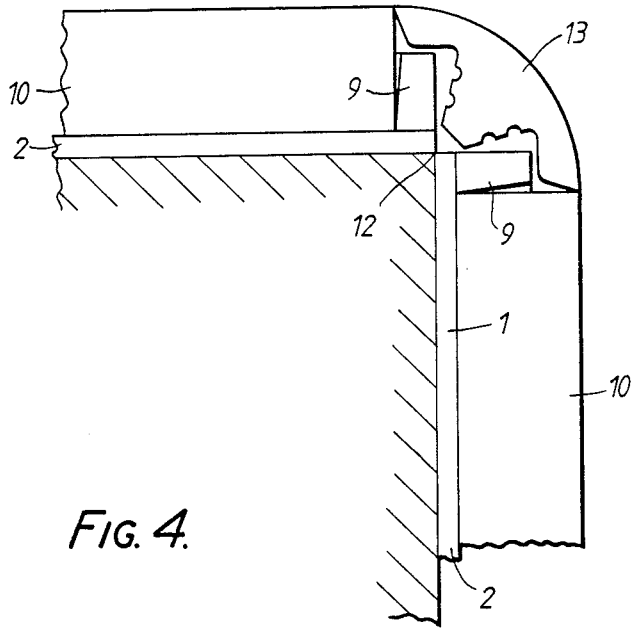
Figure 5:
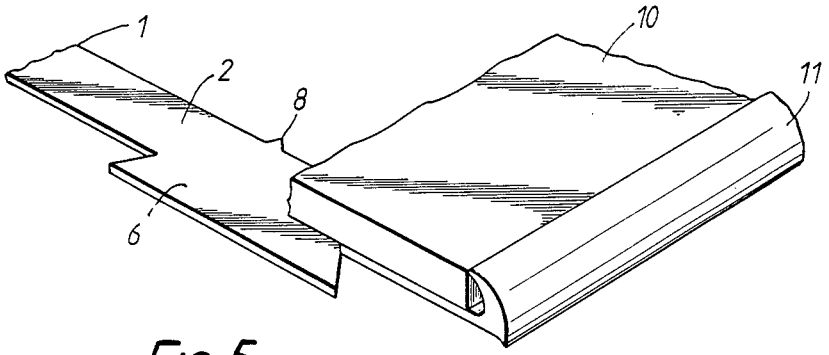

For a better understanding of the invention, and to show how the same may be carried into effect, reference will now be made, by way of example, to the accompanying drawings, in which:

FIG. 1 is a plan view of a relatively small area of a tiling system matrix constructed in accordance with the invention, FIG. 2 is a section, to an enlarged scale, taken on the line II—II in FIG. 1, FIG. 3 is a perspective view to substantially the same scale as FIG. 1 showing an area of the tiling system matrix constructed and arranged for tiling around a convex corner interconnecting two relatively perpendicular surfaces, FIG. 4 is a view to a considerably enlarged scale as seen in the direction indicated by an arrow IV in FIG. 3 and shows the matrix area of FIG. 3 in use together with the employment of an auxiliary member to complete the tiling around the convex corner, and FIG. 5 is a perspective view to substantially the same scale as that of FIG. 2 showing one corner of an area of a matrix that may advantageously be employed along a free edge of a tiled region, part of one tile also appearing in FIG. 5.

Figure 6:
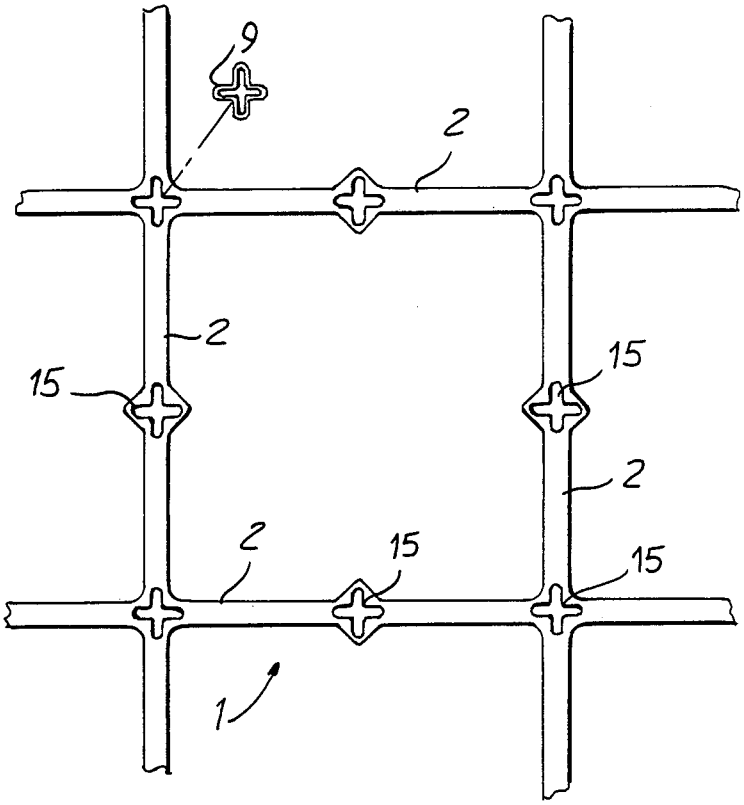

FIG. 6 is a plan view of an area of an alternative embodiment of a tiling system matrix.

Referring firstly to FIGS. 1 and 2 of the accompanying drawings, a relatively small area of a matrix 1 is illustrated that is intended for use in fastening standard 150 millimeter square (approximately 6×6 inches) glazed ceramic tiles to the surface of a vertical wall or, alternatively, to a horizontal or inclined surface. Such tiles conventionally have a thickness of approximately 5.0 millimeters but the thickness will vary with tile size and other factors. The matrix 1 could, of course, be dimensioned to co-operate with square tiles of other dimensions and/or to receive tiles in staggered rows or other patterns.

The matrix 1 is formed from a somewhat flexible, but substantially inelastic material which it is prefered should be a synthetic plastics material, an injection moulding grade of high impact polystyrene having been found to be very satisfactory for this purpose although the employment of other synthetic plastics materials or of alternative somewhat flexible, but inelastic, materials is by no means excluded. The matrix 1 defines an apertured portion 2 that, when in use on a flat surface, will be substantially planar, the portion 2 having a uniform thickness of substantially 1 millimetre and being formed throughout most of its area with a regular pattern of substantially square openings 3, at its four corners with four smaller substantially square openings 4, and along its edges, between the four corners, with a plurality of regularly spaced apart substantially oblong openings 5 whose lengths are the same as the widths, in parallel directions, of the substantially square openings 3.

FIG. 1 of the drawings shows that, at regular intervals along each of two relatively perpendicular free edges of the illustrated area of matrix 1, each such edge exhibits a plurality of extensions 6 of broad dove-tailed configuration whilst, along the other two relatively perpendicular free edges of the same area of matrix 1, a plurality of recesses 7 of broad dove-tailed shape are formed which recesses 7 exactly match the extensions 6 in size and shape. Each extension 6 and each recess 7 lies midway along the length of the outermost edge of the opening 4 or 5 which it immediately neighbours.

In addition to the extensions 6 and recesses 7 that are formed along the free edges of the area of matrix 1, each of the openings 3 is formed, midway along the length of each of its four edges, with relatively small V-shaped projections 8 and, similarly, each opening 5 is formed, midway along each of its two opposite and parallel longer edges, with further exactly similar projections 8. With this arrangement, there are straight rows of the projections 8 in exact alignment with the centres of extensions 6 and recesses 7 at opposite edges of the complete area of matrix 1, such rows thus being in exact parallel relationship with opposite basically straight edges of the matrix area 1 itself.

It can be seen in FIG. 1 of the drawings that each substantially oblong aperture 5 is a little less than half the size of each substantially square opening 3 and also that each smaller substantially square opening 4 is substantially one quarter the size of each larger substantially square opening 3.

One side of the matrix 1 is provided with a pattern of projections 9 that stand proud from said side by substantially 2.5 millimeters which height, it will be noted, is less than the minimum thickness of a standard glazed ceramic tile that will co-operate therewith. FIG. 1 of the drawings shows, at locations adjacent each corner of each substantially square opening 3, the projections 9 in a cruciform disposition which is not, however, essential. Instead of the four limbs of each cross being joined together as illustrated, said four limbs may be spaced apart from one another by a distance leaving a central region of each cross open or blank. Single projections 9 that correspond to one limb of one of the cruciform dispositions are arranged around the four free edges of the area of matrix 1 that is shown in FIG. 1 of the drawings, each such single projection 9 being perpendicular to, and being disposed immediately alongside, the edge concerned and having its length exactly in alignment with corresponding limbs of a row of the cruciform disposition projections 9.

In use, the flat side of the matrix 1 which is opposite to that bearing the projections 9 is secured to a wall or other surface that is to be tiled by employing an adhesive which may conveniently, but not essentially, be the same adhesive that is to be used for fastening the tiles themselves, a solvent-based neoprene contact adhesive or some other adhesive compatible with the material from which the matrix 1 is formed. If desired, this flat side, and/or the side of the matrix 1 bearing the projections 9, may be ribbed or otherwise roughened to improve its keying co-operation with any adhesive. It has already been emphasied that FIG. 1 of the drawings shows a relatively small area of the matrix 1 and it is possible for it to be produced in much larger areas, such as in sheets measuring 121.92 centimeters (4 ft.) long and 121.92 centimeters (4 ft.) wide. The inelastic flexibility of the matrix material is such that a sheet of the matrix having relatively large dimensions can be formed into a roll without permanent deformation but, for transport and handling generally, a flat configuration is usually more convenient. The use of relatively small areas of the matrix 1 is advantageous in regard to handling and storage and larger areas can, of course, be accurately produced merely by entering the extensions 6 of one "smaller" area into the matching recesses 7 of a neighbouring area. Across the junctions between correctly aligned areas of matrix 1 that are joined together in this way, two substantially oblong openings 5 and the material of the matrix 1 between them will effectively be equivalent to one of the larger substantially square openings 3 thus spacing apart cruciform disposition projections 9, across such a junction, by the same distance as the spacing between immediately neighbouring cruciform disposition projections 9 on a single area of the matrix 1. Similarly, two neighbouring smaller substantially square openings 4 effectively correspond to a single substantially oblong opening 5 and four such smaller substantially square openings 4 at the four adjoining corners of four areas of matrix 1 are equivalent to a single larger substantially square opening 3. There will inevitably be places at which some shaping of one or more areas of matrix 1 will be required to avoid obstructions on the surface to be tiled and this shaping can be quickly and easily effected using a strong and sharp pair of scissors.

The straight rows of projections 8 are very useful in lining up the areas of matrix 1 in parallel relationship with vertical and horizontal edges of walls, horizontal edges of floors and drawn or other lines relative to which the eventual rows of tiles must extend in as parallel relationship as possible. Using adhesive and, sometimes, scissors, it is usually possible to cover a wall or other surface with the matrix 1 quite quickly. If the tiling is to come to a free edge, then use may be made of an area of the matrix 1 such as that of which a small portion is shown in FIG. 5 of the drawings, such area being, if desired, in the form of a finishing strip of relatively narrow width. Whatever its formation, the area of matrix 1 that is shown in FIG. 5 has a lip 11 defining an outer convexly curved surface which stands proud from the apertured portion 2 of the matrix area 1 by a distance equal to the thickness of a tile 10, a part of one such tile 10 being shown in FIG. 5. It will immediately be seen from FIG. 5 that the lip 11 neatly finishes the free edge of the tiling without needing to employ known tiles that are specifically made for that purpose and which, along one edge, have a rounded and glazed extension of the flat glazed surface thereof.

The area of matrix 1 exhibiting the lip 11 can, if it is in the form of a finishing strip, be furnished in a width that will allow it to co-operate with one of the free edges of one matrix 1, such as that shown in FIG. 1 of the drawings, to produce, along that free edge, the spacing between the lip 11 and a parallel row of limbs of the nearest cruciform disposition projections 9 that is the same as the spacing between immediately neighbouring cruciform disposition projections 9 on the surface of a single area of the matrix 1. Since grouting is usually white in colour, it is desirable that any finishing strip or other area of matrix 1 that exhibits the lip 11 should be produced in that colour so that the eventual visibility of the lip 11 will not be inharmonious. Each finishing strip or other area of matrix 1 incorporating one of the lips 11 is provided with extensions 6 and/or recesses 7 to enable it to co-operate with the recesses 7 and/or extensions 6 of neighbouring areas of matrix 1. If desired, the lip 11 may define a shape other than the cylindrical convex curvature which is illustrated.

It may be that tiling is to be continued round, for example, a 90° convex angle between two vertical walls or between a vertical wall and a horizontal surface and it is possible to provide areas of the matrix 1 specifically adapted for that purpose. FIG. 3 of the drawings shows one such area, said area comprising two permanently interconnected sections that are moulded together with a relatively thin, and therefore relatively flexible, junction 12 between them which junction 12 will bend readily around any corner rendering the use of, for example, an adhesive tape unnecessary, such adhesive tape being employable, as an alternative, to join together two straight, or straightened by scissors, edges of two initially separate areas of matrix 1 that are to be secured to relatively inclined surfaces flanking an angular corner between those surfaces. It will be seen from FIG. 3 of the drawings that, alongside the flexible junction 12 between the two relatively inclined sections or areas of matrix 1, there are a plurality of T-shaped projections with the crossbar of each T extending along the free edge and the upright thereof perpendicularly away from that edge. Thus, tiles 10 can fit between cruciform disposition projections 9 and T-shaped projections 9 at either side of the junction 12 to locate those tiles 10 properly in much the same way as has already been described.

FIG. 4 of the drawings shows the matrix 1 in use around a 90° angle formed between two flat surfaces and shows the crossbars of T-shaped projections 9 standing proud from the matrix portions 2 at the adjacent edges of those portions 2 which flank the interconnecting flexible junction 12. A tile quadrant 13 may be secured by tile adhesive and/or grouting around the corner between the tiles 10 flanking that corner. Alternatively, an extruded synthetic plastics quadrant 13 may take the place of ceramic quadrants 13 having glazed cylindrically curved surfaces. The angular junction between two walls or other surfaces might not be a 90° junction and glazed ceramic or synthetic plastics filling strips subtending angles of 45°, 60° and so on at their centres of curvature can be provided for employment in such situations. It is not, of course, essential that the exposed surface of each quadrant 13 or equivalent finishing strip should be a cylindrically curved surface and an oblique flat surface, an angular finish or some other desired shape can equally well be provided.

Once a wall or other surface that is to be tiled has been covered with the matrix 1, the tiles 10 will fit between the various projections 9 with a light frictional engagement or can be retained by a small, easily removable, quantity of adhesive, either arrangement allowing at least some of the tiles to be temporarily placed in their final positions before actually using a tiling adhesive to fix them permanently in those positions. This is particularly useful if a pattern of tiles is to be produced since it enables the tiles which bear the pattern elements or decorations on their surfaces to be temporarily installed to ensure that their relative spacing, clearance from the floor and the ceiling and so on, is exactly correct before finally fastening them in position together with the surrounding "plain" or contrast tiles. The tiles are installed in a substantially conventional manner merely by applying a proprietory tiling adhesive onto their rear surfaces and pressing them into position to spread that adhesive onto the wall or other surface itself, through the openings 3 and/or 4 and/or 5 and onto the exposed surface of the matrix 1 that surrounds those openings. The various projections 9 ensure that a substantially exactly uniform spacing between the tiles is automatically produced and this spacing is filled with proprietory or other grouting in a conventional manner by "wiping" it into the spaces between the tiles and using a damp cloth or the like or a proprietory tool to remove any excess left on the glazed surfaces of the tiles. It will be remembered that the projections 9 have a height which is less than the minimum thickness of the tiles 10 so that the grouting over the projections 9 will conceal them.

At a 90° angular corner between two walls, as discussed above, the crossbars of the T disposition projections 9 both provide the correct spacing, and act as a guide, for the installation of the ceramic tile quandrants 13 (FIG. 4) or an equivalent synthetic plastics extrusion either of which may be provided in a range of different colours to match, or contrast with, the colours of the neighbouring tiles 10. Alternatives to the use of the thin synthetic plastics junction 12 that flexibly interconnect two matrix portions 2 include the employment of the previously mentioned thin flexible adhesive tape to join said portions 2 together in the manner of a hinge or providing small projections along the edge of one portion 2 and recesses of matching widths along the co-operating edge of the other portion 2 so that, when the two portions 2 are disposed in a manner equivalent to that illustrated in FIGS. 3 and 4 of the drawings, the projections along one edge will fit in the recesses along the other edge to provide a correct location of the matrix 1 around the angular corner. A still further possibility is to provide alternate projections and recesses along one edge to co-operate with alternate recesses and projections along the other edge. The projections may be of such an extent that they will stand proud of the surface of the matrix portion 2 having the edge recesses into which said projections are entered so that the latter can then serve a similar function to the crossbars of the T-shaped projections 9 although, with this arrangement, the shape of the ceramic quandrants 13 or equivalent synthetic plastics extrusions will need to be modified to co-operate correctly therewith.

The described and illustrated arrangement of the extensions 6, recesses 7 and projections 8 is by no means essential; the extensions 6 and recesses 7 may be given other co-operating shapes but it is preferred that those shapes should be arranged to interlock with one another. The projections 8 serve merely for alignment purposes and any alternative shapes which will satisfactorily accomplish this may equally well be used. The spacing between the projections 9 and the shapes and sizes of the openings 3, 4 and 5 can readily be changed to enable oblong or other tiles to be used instead of square tiles or for co-operation with square tiles of sizes which differ from the frequently employed wall tile size that is mentioned above.

Although rarely employed, even tiles of shapes other than rectangular could be used, needing only to co-operate with appropriate shapes and dispositions of the projections 9 and of the openings in the portions 2 of the matrix 1. Purely as examples, triangular, hexagonal or circular tiles could advantageously be mounted by a system in accordance with the invention. Clearly, the shapes of the openings 3, 4 and 5 that are shown in the drawings are far from being essential although the illustrated shapes are probably the most economic as regards use of the material from which the matrix 1 is formed. Nevertheless, circular, octagonal or other openings could be used in place of the openings 3 and 4 and oval or irregular octagonal openings in place of the oblong openings 5.

In addition to serving for alignment purposes, the projections 8 can be of considerable assistance in providing guidance for cutting of the matrix 1 where, purely for example, a finishing strip is to be used alongside a portion of the matrix 1, the finishing strip being arranged as briefly described with reference to FIG. 5 of the drawings. It is now conventional to produce new buildings, and to alter existing buildings, employing pre-fabricated wall panels and one aspect of the invention involves incorporating areas of the matrix 1 of this tiling system into such pre-fabricated panels so that, after installation, the panels are immediately ready for tiling. Even when this work is to be done by an experienced professional tiler, the use of the system is of considerable benefit, particularly if a pattern of tiles is to be installed or a number of "picture" tiles with a plain surround.

The system which has been described enables even the rankest amateur tiler to produce large areas of finished tiling both relatively quickly and relatively easily with an absolute minimum of blemishes and irregularities, particularly as regards the grouted spacing between the installed tiles.

Whilst the invention has been described principally in regard to the tiling of walls, it will immediately be apparent that it is used in substantially the same way, and with the same benefits, in the tiling of ceilings, floors and inclined surfaces. The system is not confined to employment with glazed ceramic tiles and is of equal assistance when installing synthetic plastics, cork, non-glazed and other tiles. Since the matrix 1 is inextensibly flexible, it can be used in the tiling of both concave and convex curved walls or other surfaces as well as for the tiling of strictly planar surfaces.

Instead of the projections 9 being integral with, or fixedly secured to, the portions 2 of the matrix 1, each such portion may be formed with a pattern of relatively small, round, cruciform or other holes and initially separate projections 9 may be positioned on the portions 2, using these holes, to suit the size of tiles to be installed by the system as can be seen in FIG. 6. With this arrangement, the projections 9 can be installed at different points enabling the same matrix 1 to be adjusted for use with tiles of various sizes. Provision may be made to produce the matrix 1 in strip form to allow a continuous "spacer" to be inserted between the matrix strips. The openings 3, 4 and 5 may receive portions of tile mosaic in which several relatively small tiles are secured to a backing sheet.

We claim

1. A tiling system which comprises the provision of a matrix defining a substantially planar apertured portion for adhesive attachment to a surface that is to be tiled and whose apertures constitute substantially all of the area of the matrix, the apertured portion being provided with a pattern of projections whose size and positions are such that in use, tiles can fit between the projections and seat on the apertured portion and be adhesively secured to said surface by way of the apertured portion and the apertures therein whilst being spaced apart from one another by said projections to facilitate uniform grouting between the tiles, the projections having an axial length and height less than the width, length and height of any tile that may be adhered to the surface, and wherein the pattern of projections is detachably secured to said apertured portion.

2. A tiling system which comprises the provision of a matrix defining an apertured portion for adhesive attachment to a surface that is to be tiled and whose apertures constitute a major portion of the area of the matrix, the apertured portion being provided with a pattern of projections whose sizes and positions are such that, in use, tiles can fit between the projections and be adhesively secured to said surface by way of the apertured portion and the apertures therein whilst being spaced apart from one another by said projections to facilitate uniform grouting between the tiles, wherein means formed on the apertured portion substantially midway of at least one aperture is provided to assist in aligning the matrix in relation to the edges of the walls, floors, ceilings and other surfaces that are to be tiled and in relation to any drawn or other guide lines carried thereby.

3. A tiling system according to claim 2, wherein the matrix portions are provided in the form of rectangular areas thereof, and wherein means is provided along free edges of each matrix area to assist in accurately positioning that area relative to other initially separate areas during the installation of the matrix on a surface that is to be tiled.

4. A tiling system according to claim 3, wherein the accurate positioning means along the free edge of one matrix area is arranged to co-operate interlockingly with the accurate positioning means along the free edge of an adjoining matrix area.

5. A tiling system according to claim 2, wherein areas of the matrix are provided which carry, along at least one free edge thereof, an integral lip that is to remain exposed after tiling has been completed to avoid the necessity of employing tiles having rounded or other "finished" edges.

6. A tiling system according to claim 2, wherein two ares of tiling matrix are provided which areas are integrally interconnected along a common edge by a relatively thin and flexible hinge-like junction to enable said two areas to flank an angle between two surfaces that are to be tiled.

7. A tiling system according to claim 2, wherein the projections extend from the surfaces of the matrix portions by a distance which is less than the thicknesses of the tiles which are to co-operate therewith so that, upon introducing grouting between the mounted tiles, the projections will be concealed.

8. A tiling system according to claim 2, wherein the matrix, including the projections, is formed from a flexible but substantially inextensible synthetic plastics material.

9. A tiling system which comprises the provision of a matrix defining a substantially planar apertured portion for adhesive attachment to a surface that is to be tiled and whose apertures constitute substantially all of the area of the matrix, the apertured portion being provided with a pattern of projections whose size and positions are such that in use, tiles can fit between the projections and seat on the apertured portion and be adhesively secured to said surface by way of the apertured portion and the apertures therein whilst being spaced apart from one another by said projections to facilitate uniform grouting between the tiles, the projections having an axial length and height less than the width, length and height of any tile that may be adhered to the surface, and wherein the projections are initially separate from the matrix portions, said matrix portions and said projections being provided with cooperating means that will enable the projections to be attached to the matrix portions in positions that are appropriate to the sizes of the particular tiles that are to cooperate with the matrix.

10. A matrix for use in tiling, wherein the matrix defines an apertured portion for adhesive attachment to a surface that is to be tiled and whose openings constitute a major portion of the area of the matrix, the apertured portion being provided with a pattern of projections whose sizes and positions are such that, in use, tiles can fit between the projections and wherein the projections of said patterns are detachably secured to said apertured portion.

11. A tiling system which comprises the provision of a matrix defining an apertured portion for adhesive attachment to a surface that is to be tiled, the apertured portion being provided with a pattern of projections whose sizes and positions are such that, in use, tiles can fit between the projections and be adhesively secured to said surface by way of the apertured portion and the apertures therein whilst being spaced apart from one another by said projections to facilitate uniform grouting between the tiles, wherein two areas of tiling matrix are provided which areas are integrally interconnected along a common edge by a relatively thin and flexible hinge-like junction to enable said two areas to flank an angle between two surfaces that are to be tiled.

12. A tiling system which comprises the provision of a matrix defining an apertured portion for adhesive attachment to a surface that is to be tiled, the apertured portion being provided with a pattern of projections whose sizes and positions are such that, in use, tiles can fit between the projections and be adhesively secured to said surface by way of the apertured portion and the apertures therein whilst being spaced apart from one another by said projections to facilitate uniform grouting between the tiles, wherein the projections are initially separate from the matrix portions, said matrix portions and said projections being provided with co-operating means that will enable the projections to be attached to the matrix portions in positions that are appropriate to the sizes of the particular tiles that are to co-operate with the matrix.

* * * * *